US012570422B2

(12) United States Patent
Nijland

(10) Patent No.: US 12,570,422 B2
(45) Date of Patent: Mar. 10, 2026

(54) PACKAGING DEVICE AND SORTING SYSTEM FOR DIRECTIONAL PACKAGING OF PRODUCTS, SUCH AS VEGETABLES AND FRUIT, AND A METHOD THEREFOR

(71) Applicant: De Greef's Wagen-, Carrosserie- en Machinebouw B.V., Tricht (NL)

(72) Inventor: Wilhelm Jan Nijland, Tricht (NL)

(73) Assignee: De Greef's Wagen—, Carrosserie—en Machinebouw B.V., Tricht (NL)

( * ) Notice: Subject to any disclaimer, the term of this patent is extended or adjusted under 35 U.S.C. 154(b) by 52 days.

(21) Appl. No.: 18/292,831

(22) PCT Filed: Jul. 26, 2022

(86) PCT No.: PCT/NL2022/050442
§ 371 (c)(1),
(2) Date: Jan. 26, 2024

(87) PCT Pub. No.: WO2023/008998
PCT Pub. Date: Feb. 2, 2023

(65) Prior Publication Data

US 2024/0409260 A1 Dec. 12, 2024

(30) Foreign Application Priority Data

Jul. 26, 2021 (NL) ..... 2028839

(51) Int. Cl.
*B65B 25/04* (2006.01)
*B65B 5/10* (2006.01)
*B65B 57/14* (2006.01)

(52) U.S. Cl.
CPC ..... *B65B 25/046* (2013.01); *B65B 5/105* (2013.01); *B65B 57/14* (2013.01)

(58) Field of Classification Search
CPC ..... B65B 25/046; B65B 35/58; B65B 5/08; B65B 5/105; B65B 57/14
See application file for complete search history.

(56) References Cited

U.S. PATENT DOCUMENTS 5,626,238 A 5/1997 Blanc
6,691,854 B1 * 2/2004 De Greef ..... B65B 35/58 198/377.01

(Continued)

FOREIGN PATENT DOCUMENTS

EP 644120 A1 3/1995
EP 727355 A1 * 8/1996

(Continued)

OTHER PUBLICATIONS

International Search Report and Written Opinion Mailed Mar. 10, 2023 in International Application PCT/NL2022/050442 filed Jul. 26, 2022.

*Primary Examiner* — Himchan Song
(74) *Attorney, Agent, or Firm* — Shook, Hardy & Bacon L.L.P.

(57) ABSTRACT

The present invention relates to a packaging device (2) and sorting system for directional packaging of products, such as vegetables and fruit, and a method therefor. The packaging device according to the invention comprises: —a feed system (4) configured to feed products (P) and a packaging transport system for supplying and discharging packagings; —at least one measuring and positioning path (12) connected operatively to the feed system for transporting products in a transport direction; —a measuring system (18) connected operatively to the at least one measuring and positioning path and configured to measure properties of the product; —a directing system (16) for directing the product on the at least one measuring and positioning path in a suitable pick-up orientation for the product; —a packaging (Continued)

Figure 1A:
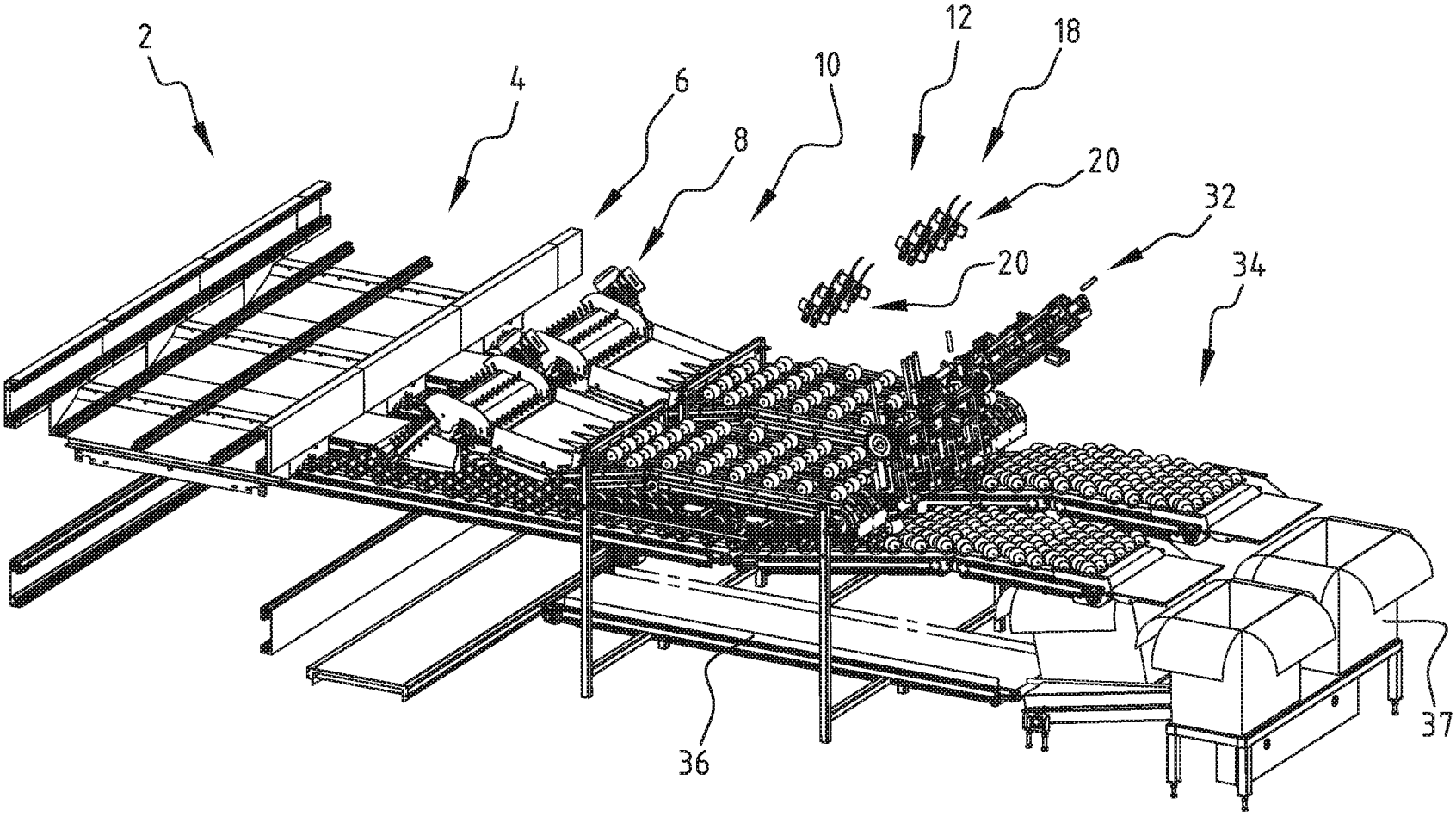

robot (32) comprising a product pick-up element, wherein the packaging robot is provided with a robot arm, comprising: —transport rotation mechanism; and—a robot arm displacing mechanism; and—the packaging device comprising a controller for controlling the measuring system, the directing system and the packaging robot.

16 Claims, 16 Drawing Sheets

(56) References Cited

U.S. PATENT DOCUMENTS

| | | | | |
|---|---|---|---|---|
| 2019/0076883 | A1* | 3/2019 | Njluland | B65B 35/58 |
| 2020/0307838 | A1* | 10/2020 | Morrow | B65B 1/34 |
| 2022/0267039 | A1* | 8/2022 | Craig | B65B 35/56 |
| 2023/0390941 | A1* | 12/2023 | Opoku | B25J 11/0045 |

FOREIGN PATENT DOCUMENTS

| | | | |
|---|---|---|---|
| WO | 2017150968 | A1 | 9/2017 |
| WO | 2021111421 | A1 | 10/2021 |

* cited by examiner

PACKAGING DEVICE AND SORTING SYSTEM FOR DIRECTIONAL PACKAGING OF PRODUCTS, SUCH AS VEGETABLES AND FRUIT, AND A METHOD THEREFOR

CROSS-REFERENCE TO RELATED APPLICATIONS

This application claims priority under 35 U.S.C. § 365 to PCT/NL2022/050442 filed on Jul. 26, 2022, entitled "PACKAGING DEVICE FOR DIRECTIONAL PACKAGING OF PRODUCTS SUCH AS VEGETABILES AND FRUIT, SORTING SYSTEM OR PACKAGING LINE PROVIDED THEREWITH AND METHOD THEREFOR," and Netherlands Patent Application No. 2028839, filed Jul. 26, 2021, entitled "PACKAGING DEVICE FOR DIRECTIONAL PACKAGING OF PRODUCTS SUCH AS VEGETABILES AND FRUIT, SORTING SYSTEM OR PACKAGING LINE PROVIDED THEREWITH AND METHOD THEREFOR." The entirety of the aforementioned applications are incorporated herein by reference.

The present invention relates to a packaging device with which it is possible to package products such as vegetables and fruit in a directional manner, wherein directional packaging relates to placing the products in a packaging with a desired orientation.

Packaging devices and packaging robots known in practice make it possible to package products in automatic manner and here position them in directional manner in or on a packaging such as a so-called packing tray, tray or other holder. The products, such as apples, are here positioned in desired manner, for instance with a red bloom directed upward and stalks pointing in the same direction. These packing trays or trays are then placed in a box or outer box for further transport and storage. In this process it is particularly the correct positioning of the product that requires various operations, sub-systems and relatively complex devices to achieve the desired end result.

NL 2016363 and NL 2002866 describe a conventional directing apparatus and packaging device whereby products can be placed in a packaging in directional manner. Various operations and sub-systems are likewise used here.

Systems known in practice make use of a transfer system whereby products are picked up with a robot from a pick-up location on the product path and are then placed in a packaging. The packagings with the set-down positions of for instance a packing tray must here be aligned with the transport path or transport paths. This limits the flexibility for handling different products and/or packagings. For this purpose use is in practice also made of so-called XYZ robots. These are however relatively complex and here have a relatively great mass. The mass inertia limits the overall processing capacity.

The object of the present invention is to provide a packaging device for directional packaging products, such as vegetables and fruit, whereby the above stated problems in respect of various operations and/or sub-systems being required are obviated or at least reduced, and wherein the capacity of such a packaging device can preferably also be increased for the purpose of setting down a product in a packaging, such as a packing tray, tray, holder or other packaging element, with a desired product orientation.

The invention provides for this purpose a packaging device for directional packaging of products such as vegetables and fruit, wherein the packaging device according to the invention comprises:

a feed system configured to feed products and a packaging transport system for supplying and discharging packagings;

at least one measuring and positioning path connected operatively to the feed system for transporting products in a transport direction;

a measuring system connected operatively to the at least one measuring and positioning path and configured to measure properties of the product;

a directing system for directing the product on the at least one measuring and positioning path in a suitable pick-up orientation for the product;

a packaging robot comprising a product pick-up element for picking the product up from the at least one measuring and positioning path in the suitable pick-up orientation and configured to set down the product in a packaging with a desired product orientation; and wherein the packaging robot is provided with a robot arm, comprising:

a transport rotation mechanism for transferring the product from the at least one measuring and positioning path to the packaging with a main rotation movement, and the transport rotation mechanism comprises a longitudinal shaft extendable in longitudinal direction; and a robot arm displacing mechanism configured to displace the robot arm substantially in a transverse direction to the transport direction; and the packaging device comprising a controller for controlling the measuring system, the directing system and the packaging robot.

By means of a feed system, such as a feed conveyor, products are supplied to a measuring and positioning path or paths connected operatively thereto. The products particularly relate to vegetables and fruit, including for instance apples, peaches and tomatoes, and other food products which can be placed in a packaging in a directional manner. Within the scope of the present invention directional packaging relates to placing of the products in a packaging with a desired orientation. The packagings relate particularly to a packing tray, tray, packing sheet or other suitable holder. Such a packaging is preferably supplied using a packaging transport system, for instance a separate supply and through-feed system for the packagings.

A measuring and positioning path is provided for the transport of the products, particularly vegetables and fruit, from the feed system via the measuring system and the directing system to the packaging robot for picking up the product from the measuring and positioning path and then setting the product down on the desired set-down position.

A measuring system is configured to measure properties of the product, which in the scope of the invention is also understood to mean the position of for instance a stalk, calyx and/or bloom of the product. The measuring system is preferably also utilized to detect one or more suitable pick-up orientations, wherein a packaging robot can pick up the product and preferably set it down with a desired set-down orientation on a suitable set-down position in the packaging.

A directing system is provided according to the invention for directing the product for the purpose of, on the one hand, measuring the product with the measuring device during transport and, on the other, orienting the product, preferably during transport of the product, for the purpose of picking up the product and setting it down in the packaging.

The directing system direct the products, such as apples, wherein the products are rotated such that for instance the so-called calyx-stalk axis lies in the correct and desired plane. This desired orientation depends on the requirements set. Is thus for instance generally desirable for said calyx/stalk axes to be placed in or on the packaging parallel to each other in a predetermined direction. In addition to a visual and aesthetic effect, it has been found that this results inter alia in the stalks of mutually adjacent products damaging each other less.

By preferably already directing or orienting the product at least partially in/on the measuring and positioning path a desired orientation of the product can already take place wholly or partially during transport of this product, so that at least one suitable pick-up orientation lies in an operating range of the packaging robot. Using the packaging robot, the product is picked up directly from the measuring and positioning path and the product is set down directly on a suitable set-down position in the packaging. This removes the need for an intermediate step with a separate directing unit in this currently preferred embodiment. This achieves a faster process and a higher capacity for processing of the products. Tests have shown that the device according to the invention with five robot arms can process 180 products per minute and a conventional XYZ system cannot exceed more than 100 products per minute in similar conditions. The number of operations performed is additionally limited so that an effective device is obtained, wherein the risk of product damage is also reduced further by the reduction of the number of operations. A more compact device can additionally also be provided, which can suffice with less installation space and which provides the same functionality as or even more functionality than conventional systems.

According to the invention, a packaging robot is provided for picking the product up from the measuring and positioning path in a desired product orientation and then placing the product in a desired orientation on a desired set-down position in the packaging. Such a packaging robot is also referred to as manipulator. The packaging robot is provided with a robot arm configured to pick up the product.

The packaging robot is provided with a robot arm comprising a transport rotation mechanism for transferring the product from the measuring and positioning path to a packaging.

By providing the packaging robot with a transport rotation mechanism the robot makes a substantially rotating movement which can be performed much faster than a substantially straight or linear movement. This reduces the so-called cycle time for setting down product from the measuring and transport path onto the packaging. With this, it is further possible to realize a smoother simultaneous movement, whereby the relatively great accelerations and decelerations are avoided. This for instance reduces the risk of losing the product during transport.

The packaging robot is provided here with a longitudinal shaft extendable in longitudinal direction. This extendable longitudinal shaft more preferably coincides with the robot arm in a collinear manner. By making use in such an embodiment of this longitudinally extendable shaft in combination with an above stated transport rotation mechanism the product can be transferred, preferably in the transport direction, from the measuring and positioning path to the packaging, wherein the extendable longitudinal shaft also in part realizes the desired horizontal displacement.

The packaging robot is therefore based here on a rotation principle, so that the relatively fast (linear) actuators can also provide for a part of the radial movement for the horizontal transport. By making use of the rotation the movement for extension using these actuators is shorter, whereby work can take place more quickly and a higher capacity of the packaging device is achieved and/or acceleration and deceleration can remain limited. The vertical and horizontal movements can also be combined. If desired, it is also possible to apply the packaging robot in combination with a conventional packaging device. It will however be apparent that application of the packaging robot in a preferred embodiment with the packaging device according to the invention enhances said advantages and effects.

Application of the rotation principle has the advantage that the product travels a smooth trajectory, advancing from the measuring and positioning path to the set-down position in the packaging. A further advantage is that the mass of the packaging robot moves only to limited extent during displacement of the product, whereby the packaging robot can move relatively quickly and a great processing capacity with the packaging device according to the invention can be achieved.

The packaging robot is further provided with a packaging robot displacing mechanism arranged for displacement wholly or partially in a transverse direction to the transport direction.

Displacement of the packaging robot in transverse direction to the transport direction enables the packaging robot to be positioned relative to the packaging in effective manner.

A further advantage of the possible displacement in transverse direction is that the flexibility for handling diverse types of packaging is increased, wherein packagings are processable, for instance with a different distribution of the set-down positions. It will be apparent that the displacement of the packaging robot relates to the displacement of the relevant parts thereof, for instance particularly the head with the product pick-up element.

An advantage of the use of the packaging robot displacing mechanism is that the packaging robot can also set down products when the packagings are not wholly aligned with the measuring and positioning path. This increases the processing speed and reduces the number of malfunctions on a processing line.

A further advantage of the use of the packaging robot displacing mechanism is that the packaging device can handle different packagings flexibly in respect of dimensioning and/or configuration of the set-down positions in the packaging. This provides a packaging device which can switch in relatively simple manner between different packagings and products without significant change-over times. In a currently preferred embodiment the robot arm displacing mechanism is configured to displace the robot arm in transverse direction to the transport direction during a main rotation movement.

By combining the movements in the transport direction and in transverse direction thereto the processing speed of the product can be further increased. This increases the overall capacity of the packaging device.

In a currently preferred embodiment the packaging robot is further provided with a longitudinal shaft rotation mechanism.

By providing a longitudinal shaft rotation mechanism it is possible to rotate the product picked up with the packaging robot during set-down of the product in order to thereby enable it to be transferred from the pick-up orientation on the transport assembly to the desired product orientation in the set-down position in or on the packaging.

In a currently preferred embodiment use is made of a combination of the above stated transport rotation mechanism, extending mechanism, longitudinal shaft rotation mechanism, and the packaging robot displacing mechanism for an optimal position of the packaging robot and/or the desired orientation of the product in or on the packaging.

In a currently preferred embodiment of the packaging device two or more measuring and positioning paths which are placed substantially parallel are provided, wherein each of these measuring and positioning paths is provided with a separate robot arm.

The packaging device preferably comprises two or more product paths positioned substantially parallel. Such a product path is also referred to as track. The use of a plurality of parallel product paths or tracks increases the capacity of the packaging device. The measuring and positioning path can optionally be driven individually per individual product path or track. In a preferred embodiment the packaging device therefore comprises two or more robot arms positioned substantially parallel. Alternatively, it is also possible to provide a number of robot arms different to the number of measuring and positioning paths. It is thus for instance possible to provide four robot arms for five measuring and positioning paths. In such an alternative embodiment a robot arm therefore serves more than one track.

In one of the currently preferred embodiments according to the invention the packaging robot is provided with a number of robot arms with pick-up elements that corresponds to the number of tracks. These are for instance 2, 3, 4, 5, 6 or a different suitable number of tracks and corresponding pick-up elements. Each individual pick-up element can preferably make its own independent movement, and each individual pick-up element can preferably likewise be individually displaced in transverse direction. This enables an alignment of the pick-up elements with the measuring and positioning path and the compartments or fruit holders in the packaging.

The use of a plurality of paths enables an increase of the capacity of the packaging device. One robot arm is preferably provided here per path in order to be able to place all products on the suitable set-down position in the packaging (s) at high speed.

The individual robot arms are preferably provided around a joint transport rotation shaft. This enables a relatively compact construction of the packaging robot and, with this, of the packaging device as a whole.

According to the invention, a controller is further provided for controlling at least the measuring system, the directing system and the packaging robot. A supply system for the packagings, such as packing trays for apples and the like, or other packaging element is preferably provided. A discharge system is preferably also provided for the filled packagings. These systems are optionally also controlled by the same controller.

In an advantageous embodiment according to the invention the controller is configured to process the obtained information about the product and then determine a suitable pick-up orientation.

In a currently preferred embodiment the controller here makes an image analysis, for instance with an image processing system, whereby images of the product obtained with one or more cameras or camera systems are analysed. A first camera is preferably provided here for measuring the product properties, and a second camera is preferably provided for detecting the set-down positions for the product and the corresponding available set-down positions in or on the packaging units. Such a second camera is therefore configured such that the area of the packaging in or on which the products are placed is visible. The second camera can therefore be used in controlling the packaging robot, taking into consideration the set-down position. In the case of a plurality of parallel tracks or transport or product paths, the second camera can also be used to control the plurality of packaging robots in combination with available set-down positions. This achieves a further optimization of the process. The camera can comprise a so-called time-of-flight camera. In another embodiment it is also possible for the camera to additionally or alternatively comprise a colour camera and/or a monochrome camera.

The controller is preferably further configured to determine a suitable set-down position for the product in the packaging. For this purpose the controller is preferably provided with a set-down detection system configured to detect set-down positions that are possible at that moment. The products already positioned in this packaging earlier are preferably taken into consideration here. Using the controller, a suitable set-down position for the product in the packaging is further preferably determined by taking into consideration the set-down positions which are still free, determined from the image analysis, and the most optimal path/trajectory for the packaging robot. In a currently preferred embodiment the set-down detection system is further configured to detect a set-down pattern in the packaging. Visual effects of products in the packaging can hereby be realized in effective manner.

It is noted that, if desired, the set-down detection system can also be applied in combination with conventional robot systems/robot arms. In such an alternative system use can be made of other components described in this application, including the camera system and image processing system, directing system and the measuring system.

Tests have shown that the error margin due to loss of fruits during pick-up and set-down with the packaging device according to the invention is reduced enormously, inter alia owing to application of the set-down detection system, from 1% error margin to an error probability of <0.01 per thousand, for instance as a result of fruits crashing into each other. This is improved further still using sensors and camera(s).

In a currently preferred embodiment a 3D image of the packaging is made with the image processing system so that separate product compartments or fruit holders in the packaging, such as the packing tray, are detected. In a further currently preferred embodiment the set-down detection system is further provided with a correcting mechanism which is configured to check during set-down whether no fruits have fallen onto the packing tray in uncontrolled manner, and is preferably configured to make an additional recording for the purpose of re-planning the process of setting down. The error margin can hereby be further reduced, and an error can be rectified in automatic manner without further adverse effects.

Optionally provided is a quality system whereby a quality assessment of the product is possible. This for instance makes it possible to detect unsuitable products and then remove them and/or set them down individually in a separate packaging. It is further optionally possible to perform an additional sorting of the products and to set them down, for instance at the most suitable position in or on the packaging, and so bring about the most favourable visual effect possible. If desired, use is made here of the above stated set-down detection system.

In an advantageous embodiment according to the invention the controller further comprises an optimizer configured to determine an order of products for picking up and/or a suitable set-down position for picked-up products, and thereby realize a desired set-down pattern for the products in the packaging.

By determining with the optimizer the most suitable set-down position for a product picked up with the robot arm the processing speed of the packaging device can be further increased. Such an optimizer particularly enables a shorter cycle time, this further increasing the capacity of a packaging device. Additionally or alternatively, the controller can determine which robot arm is most suitable for picking up a specific product. This is particularly relevant for embodiments wherein the number of robot arms is different, usually smaller, than the number of measuring and positioning paths.

It is additionally possible to realize a desired visual effect of products in the packaging by for instance taking into consideration the product colour while determining the suitable set-down position.

In a further advantageous embodiment according to the invention a packaging positioning system is provided which is configured to position the packaging in co-action with the controller.

By having the positioning of a packaging be controlled, preferably by the controller, the cycle time of the process of setting down the product from the measuring and positioning path onto the set-down location in the packaging can be reduced. The adaptation of the positioning of the packaging to the packaging device, preferably by the same controller, further reduces the risk of malfunctions.

In a preferred embodiment according to the invention the measuring system is configured to detect at least one suitable pick-up orientation of the product for packaging, preferably by making use of a camera system already stated above.

A further preferred embodiment according to the invention comprises a measuring directing part configured to rotate the product during transport of the product in the transport direction for the purpose of the measuring system, and a product orientation part configured to orient the product for packaging during transport of the product in the transport direction.

The measuring part of the directing system is configured to rotate the product at the product position such that all sides of the product are visible to the measuring system during transport of the product. This enables analysis of product with the measuring system, preferably using camera images obtained with one, two or more cameras, the images of which are analysed by an image processing system of the measuring system.

Following the measuring directing part is a product orientation part of the directing system which can be activated flexibly and which is configured to orient the product in correct manner during transport of the product, preferably as soon as a suitable or desired orientation has been determined by measurements performed using the measuring system. With the product orientation part the products are rotated and placed in a desired pick-up orientation in controlled manner. By deactivating this product orientation part at a desired moment the product can remain still in the desired position. To determine a desired orientation use is preferably likewise made of the measuring system with the image processing. Performing the product orientation during transport of the product optimizes the processing speed.

By moving the product at the product position into a desired position with the product orientation part the product can be picked up and be set down in or on a packaging in the desired orientation with a packaging robot. The packaging robot is here provided with a product pick-up element for thereby picking the product up from the measuring and positioning path and setting it down in or on the packaging. Such a product pick-up element is for instance a vacuum system with suction cups and/or a gripper with fingers.

As stated here, the measuring system is configured to measure product properties and additionally determine a suitable pick-up orientation. An effective packaging process can thereby be realized. In most cases there will be more than one suitable pick-up orientation so that there is a set of pick-up orientations. As soon as the product has been moved into one of these pick-up orientations, or into the most suitable thereof, the product orientation part of the directing system will be deactivated and the product will be carried to the pick-up location without rotation. Once there, the packaging robot will pick the product up from the measuring and positioning path and transfer it to the packaging device using the product pick-up element. The packaging robot here takes into consideration a determined pick-up orientation so that the product is placed in or on the packaging in directional manner.

The directing system of the packaging device can be embodied in diverse ways. In a currently preferred embodiment use is made in the directing of a process of rolling, wherein a rolling surface is provided on the directing system, whereby the roller elements such as diabolos rotate. An alternative for this can make use of active components controlled in real time, such as servomotors. In addition to said servomotors it is also possible to provide a further alternative embodiment which makes use of toothed belts, chains or other transmission and transport elements. These alternatives however require additional components for the directing system. In a currently preferred embodiment the transport assembly is therefore provided with a contact element whereby contact is made with the rolling surface and whereby the roller elements, such as diabolos, are rotated for the purpose of measuring and/or orienting during transport of the product.

The directing system is here preferably configured to direct a product such that at least one suitable pick-up orientation from the above stated set lies in an operating range of the packaging robot. This means that the directing system is configured for rotation of the product around preferably at least a substantially horizontal rotation axis in order to achieve a suitable pick-up orientation. Optionally provided for the product is an additional rotation axis which is preferably created substantially perpendicularly of the first rotation axis and with which the orientation can be further optimized. Such an additional rotation axis can for instance be realized by rotating the two diabolo halves for the product transport differently.

The directing system preferably comprises an activating element whereby the product orientation part of the directing system is activatable in use until the product on the transport assembly has a suitable pick-up orientation. Such an activating element is preferably provided with a contact element already stated above, which can be moved away wholly or partially or is otherwise able to break the contact between the transport assembly and the drive of for instance the rolling surface. It will be apparent that other embodiments of such an activating element are also possible.

In an advantageous embodiment according to the invention the directing system is provided with at least two drives operating in parallel, wherein at least two product assemblies, lying adjacently in the transport direction, for at least the product orientation part are independently driveable.

By providing on the directing system two parallel drives per track, i.e. the transport or product path, of the measuring and positioning path two successive transport assemblies become rotatable independently of each other, preferably in any case in respect of the product orientation part. It has been found that, hereby, the individual transport portions in which the product can be rotated are long enough to have the product perform the necessary number of revolutions for measuring and orienting, and successive products can placed in a desired pick-up orientation independently of each other.

In a currently preferred embodiment according to the invention the measuring and positioning path is provided with one and preferably more transport assemblies, wherein each transport assembly comprises two roller elements lying adjacently in the transport direction and defining a product position.

In this embodiment the roller elements are preferably so-called diabolos. Other suitable roller elements can also be provided if desired. In the product position a product is in contact with both roller elements. An individual product assembly is preferably suitable for displacing a single product.

In a currently preferred embodiment the roller elements are diabolos and two diabolos lying adjacently in the transport direction form a transport assembly. Between such separate diabolo sets a position is as it were empty, so that products succeeding each other in the transport direction can be directed individually. Such a path of transport assemblies with diabolos is optionally provided at a slight incline on the infeed side in order to optimize the dosing, i.e. the distribution of products over the product positions. It has been found that when diabolos are applied in the transport assembly, the desired orientation of the products can be achieved more quickly and can also be better preserved. This enables a cost-effective system according to the invention with limited requirement in respect of installation volume. This further makes the device according to the invention effectively applicable in practice.

In a further advantageous embodiment according to the invention the packaging device further comprises a dosing system placed between the feed system and the measuring and positioning path.

By providing a dosing system products are placed on the available product positions and, if possible and relevant, distributed over the individual and available tracks in the most optimal manner possible.

In a currently preferred embodiment the dosing system comprises a slide plate in which a pattern of tracks or paths is arranged and wherein this slide plate is operatively connected to a vibration motor, whereby it is prevented that products lie still on the slide plate. This vibration motor further makes it possible to limit the angle of inclination of the slide plate, whereby the speed of the product remains limited without any risk of the products lying still. This reduces the risk of damage to the products. It will be apparent that the geometry of the slide plate, the frequency and amplitude of the applied vibration and the geometry of the roller elements, such as diabolos, of the transport assembly and the incline of this path together bring about a correct dosing of the products over the product assemblies. Additional elements such as brushes, additional vibrating provisions and/or product displacers can be applied if desired.

An elevator conveyor is preferably also provided between the feed system and the measuring and positioning path. This makes it possible to provide a height adjustment. The elevator system here preferably comprises an elevator conveyor with so-called fruit carriers. It will be apparent that other types of elevator conveyor, such as corrugated belts, can also be applied according to the invention. During this elevation in height a distribution is preferably also imparted of products in the width of the original tracks, if more than one track is provided in the packaging device according to the invention.

The invention further also relates to a sorting system or packaging line for directional packaging of products, such as vegetables and fruit, wherein the sorting system comprises:

- a sorting device for sorting products; and
- a packaging device, operatively connected to one or more sorting outlets of the sorting device, in an embodiment as described above.

Such a sorting system or packaging line provides similar advantages and effects as described for the packaging device. A packaging line processes pre-sorted products with a packaging device according to the invention.

The invention further relates to a method for directional packaging of products, such as vegetables and fruit, comprising the steps of:

- providing a packaging device in an embodiment according to the invention;
- supplying products with the feed system;
- determining a pick-up orientation suitable for the packaging robot with a measuring system during transport of the product;
- directing the product with the directing system during transport of the product such that the product is positioned in the suitable pick-up orientation; and
- transferring the product from the transport assembly to a packaging or holder with the packaging robot.

Such a the method provides similar advantages and effects as described for the packaging device and/or the sorting system or packaging line.

The method according to the invention can particularly provide an efficient packaging process for vulnerable products in particular, wherein products are placed in a packaging or holder with a product orientation in a directional manner. By shortening the cycle time in this process packaging costs can be reduced and the risk of damage to the product is additionally further reduced.

With the method according to the invention it is possible to orient the products, such as apples, which are provided with a bloom and/or stalk and/or a calyx, in the packaging or holder in a desired manner. This makes it possible to have for instance the stalks point in the same direction and/or to orient the bloom in a determined pattern.

Figure 1B:
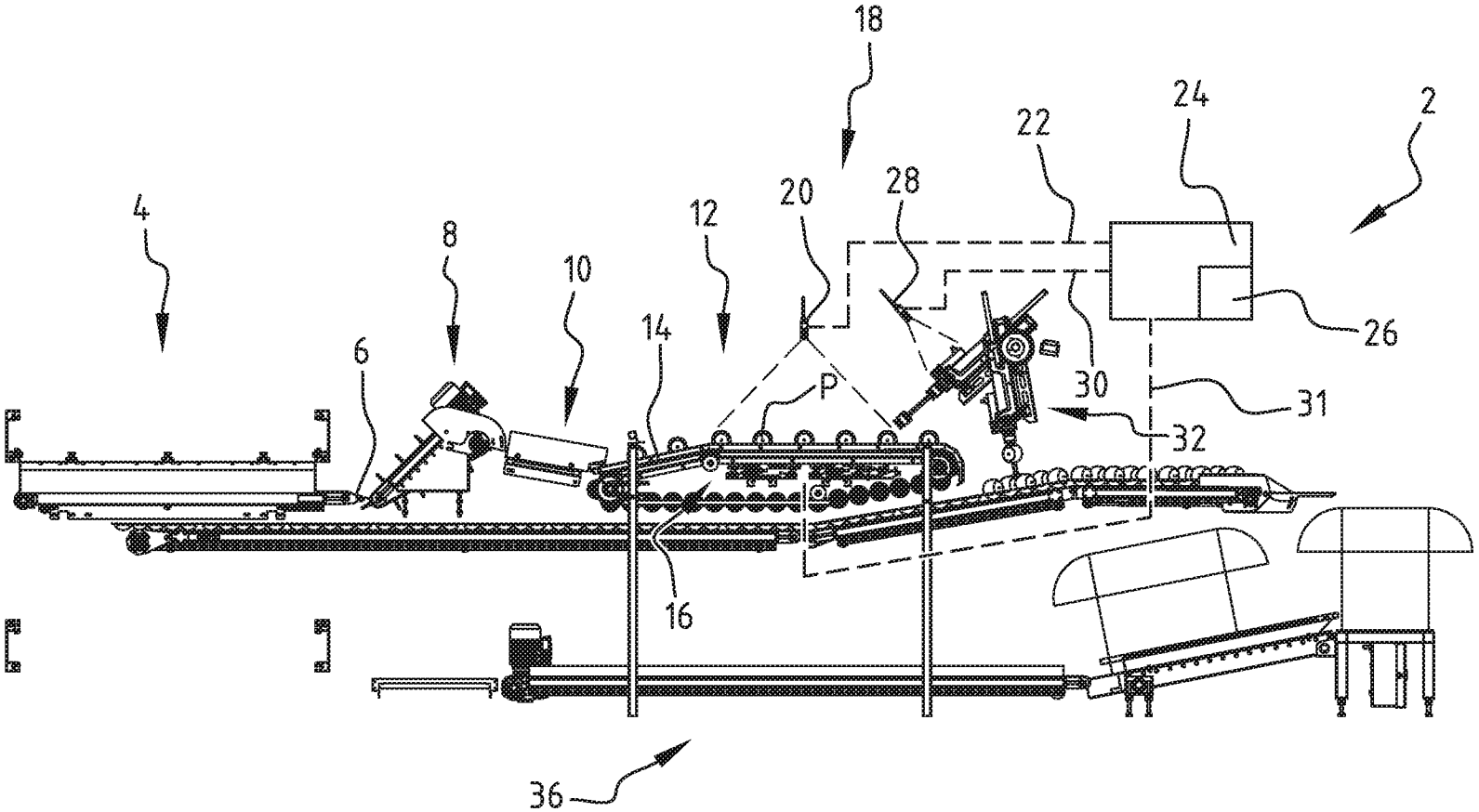
Figure 2:
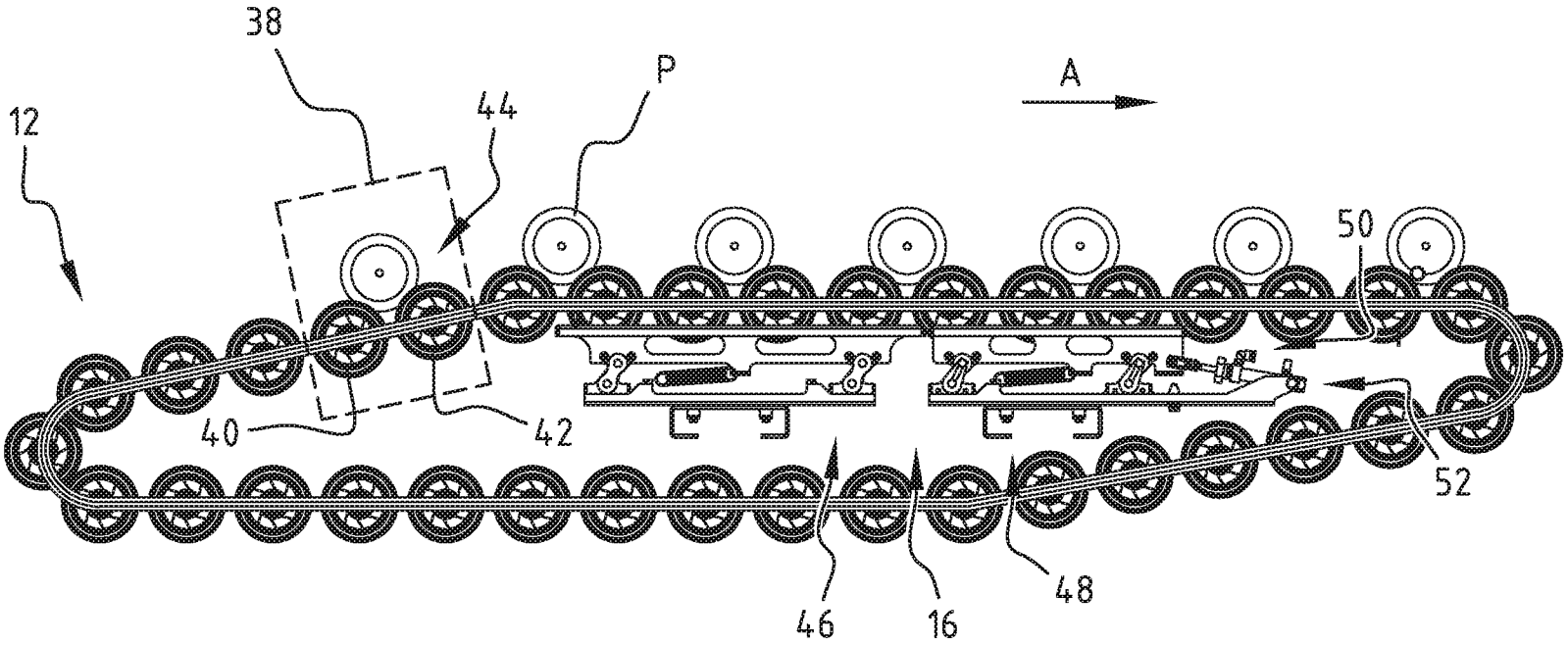
Figure 3A:
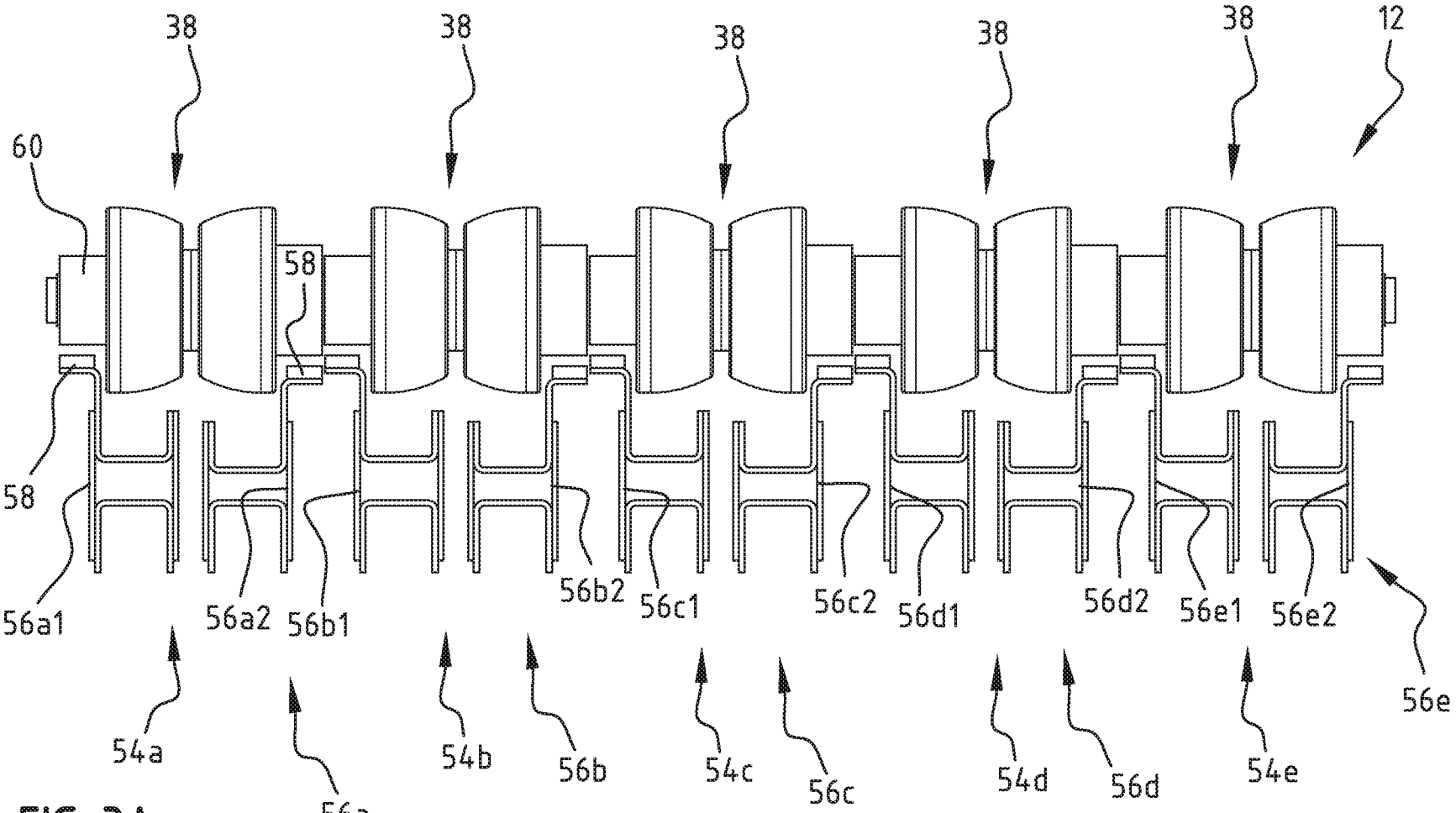
Figure 3B:
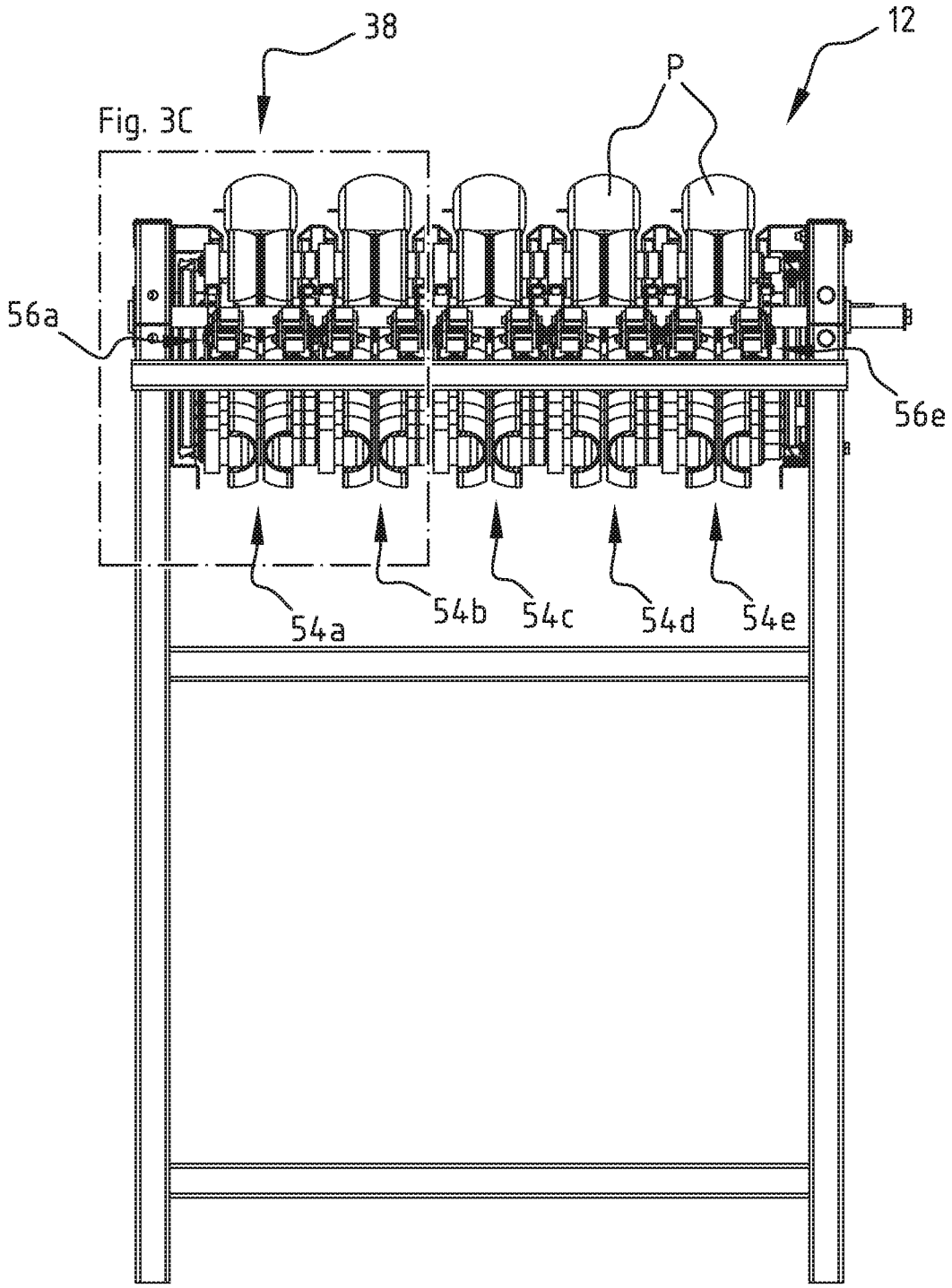
Figure 3C:
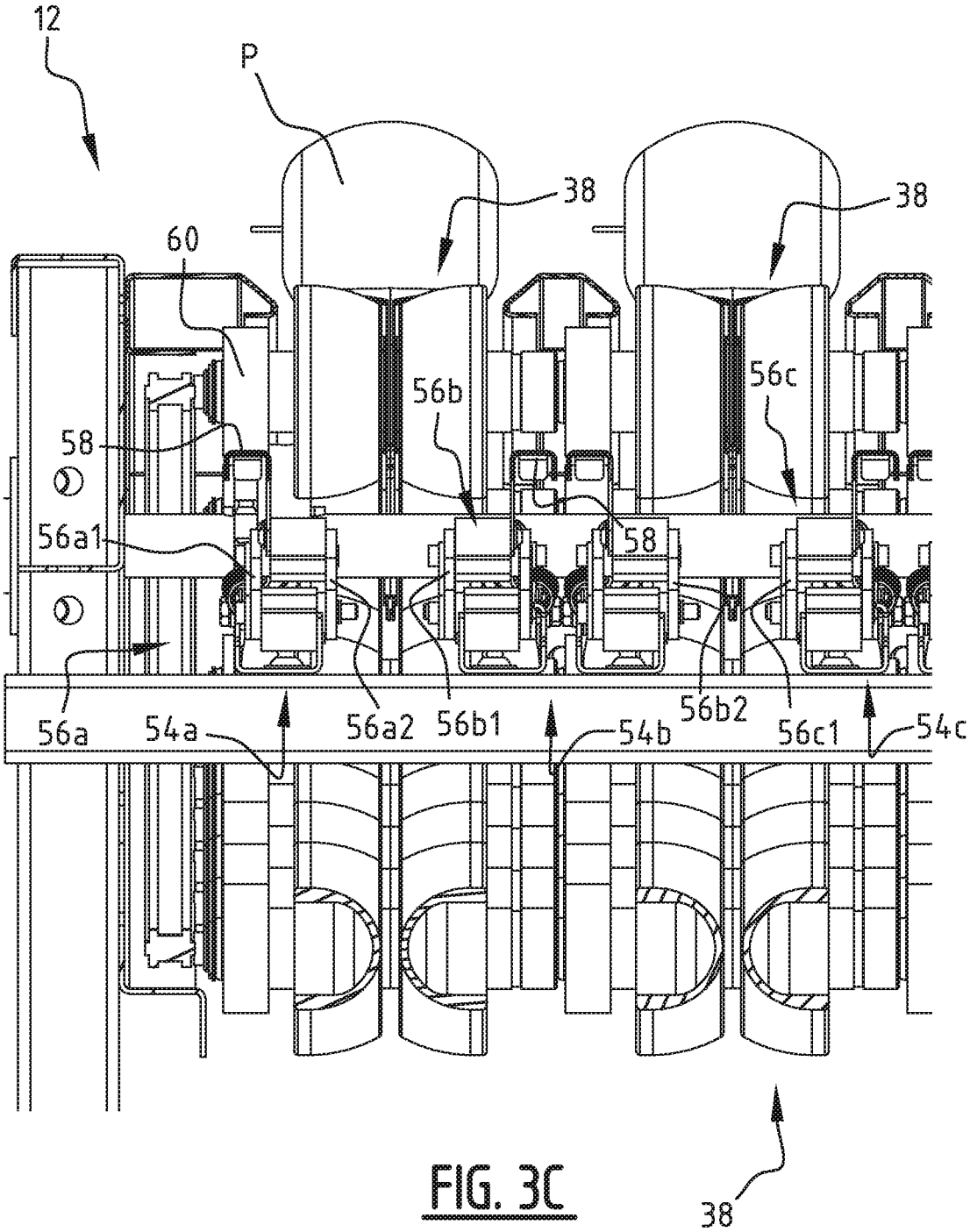
Figure 4A:
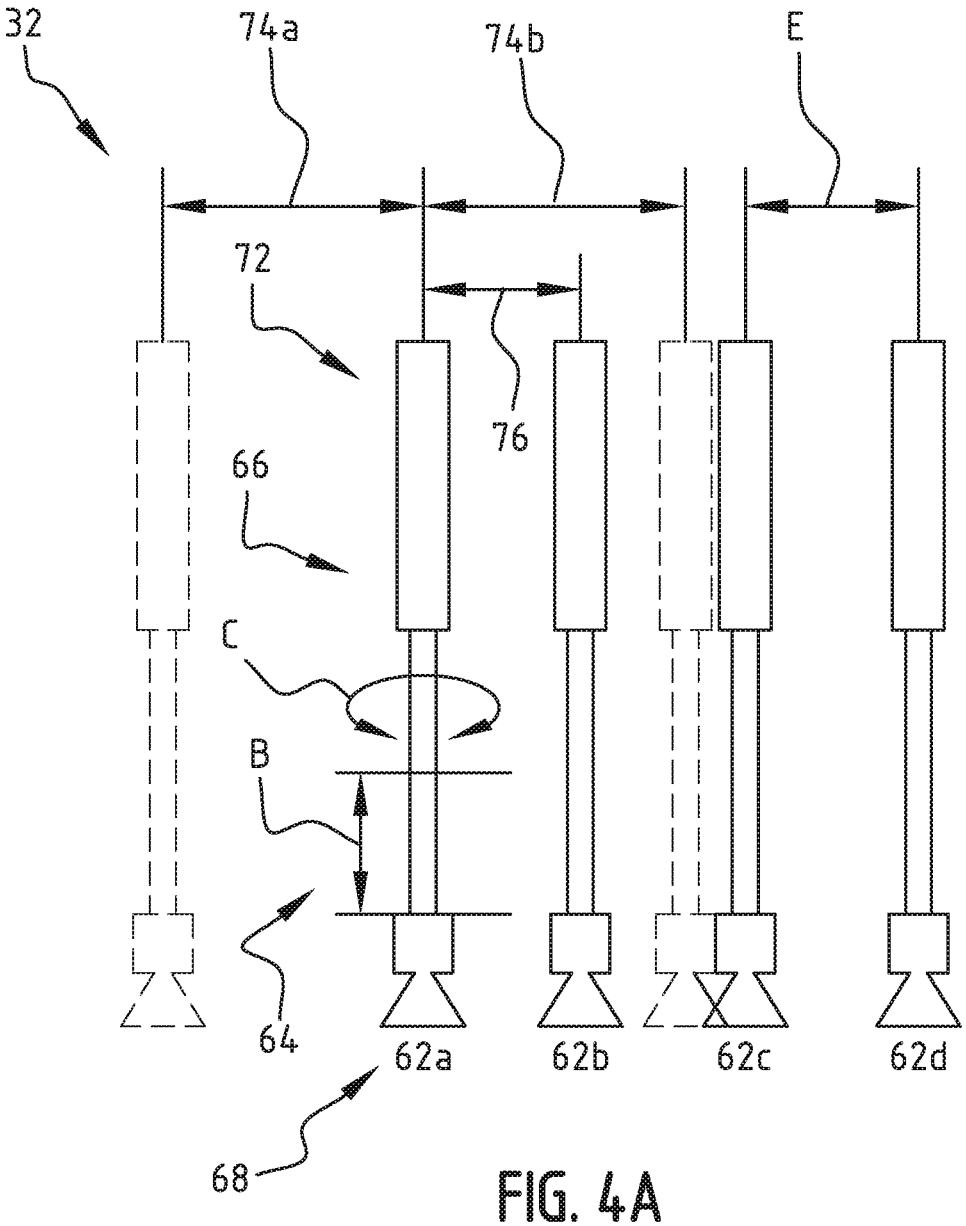
Figure 4B:
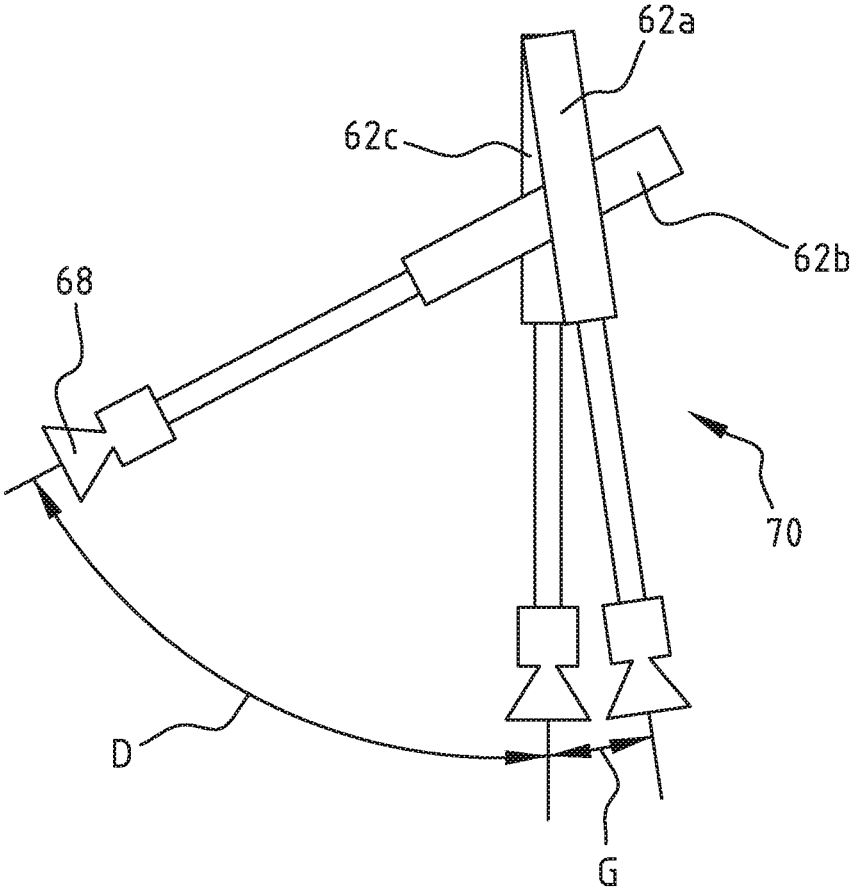
Figure 4C:
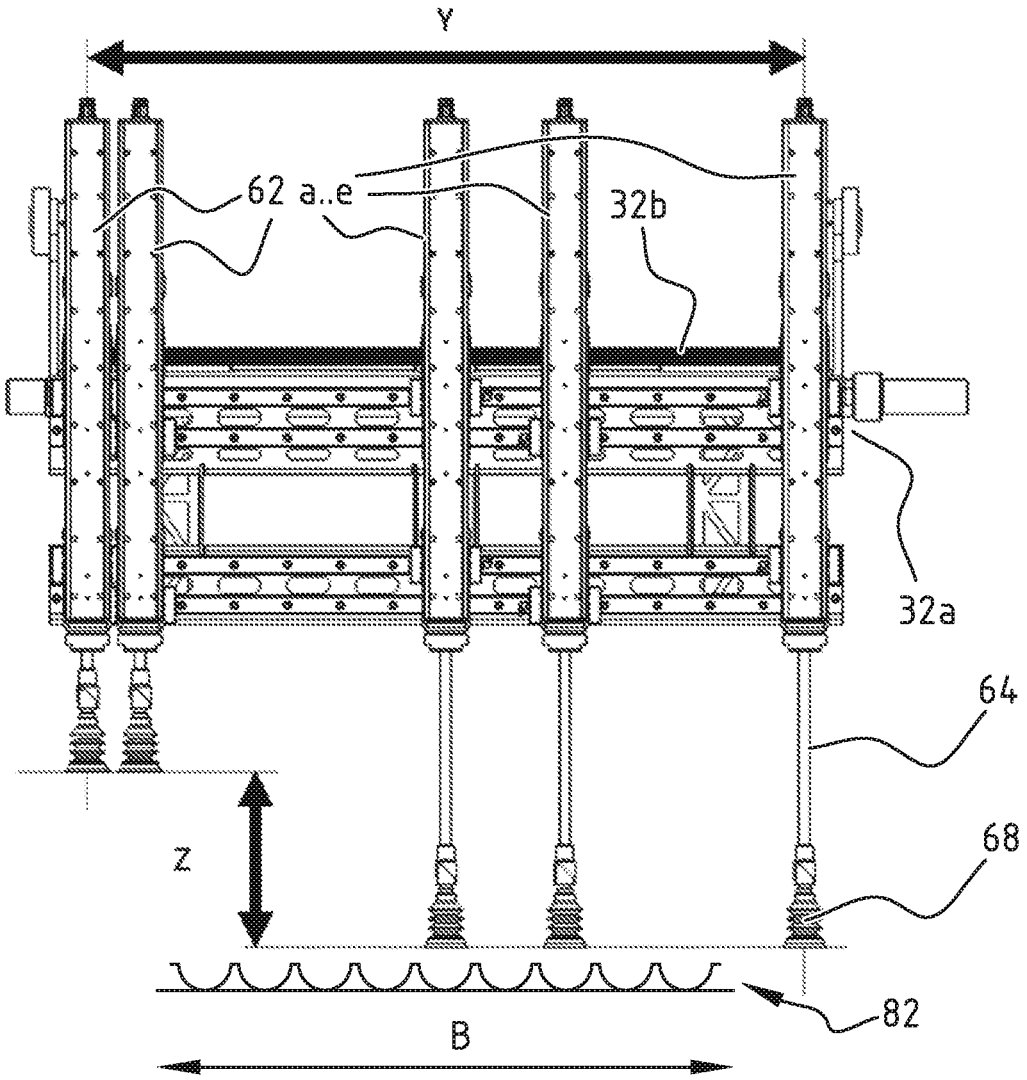
Figure 5:
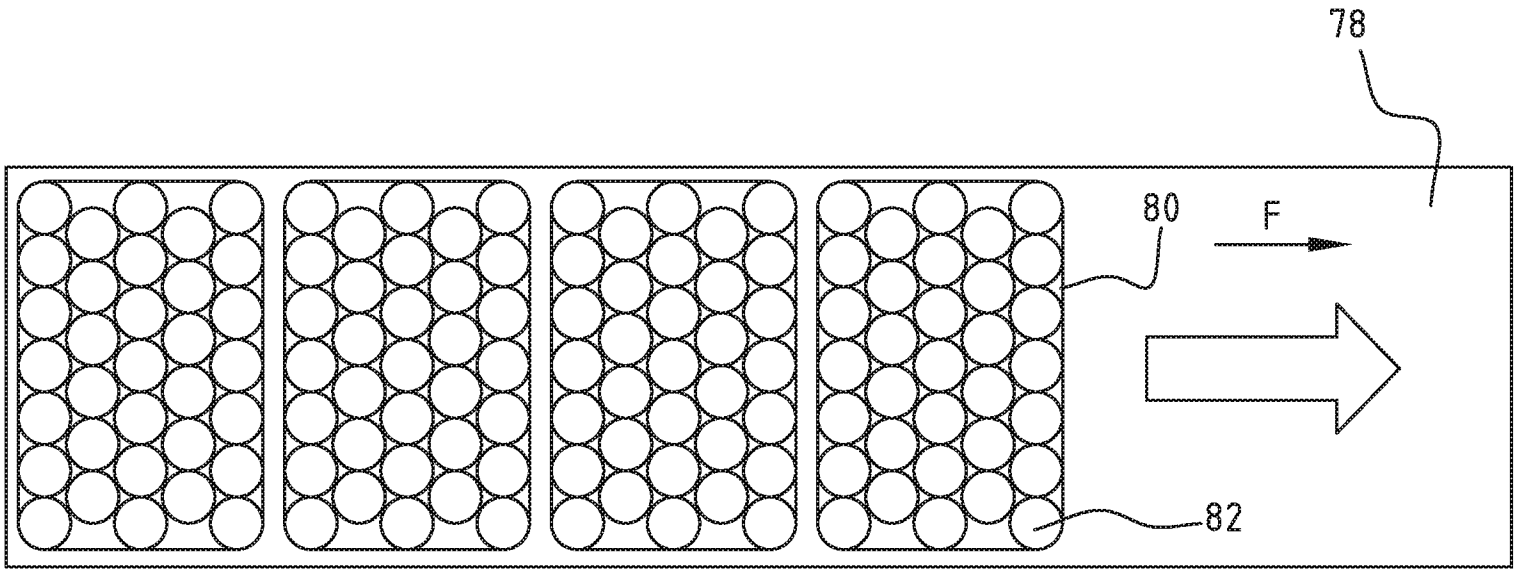
Figure 6A:
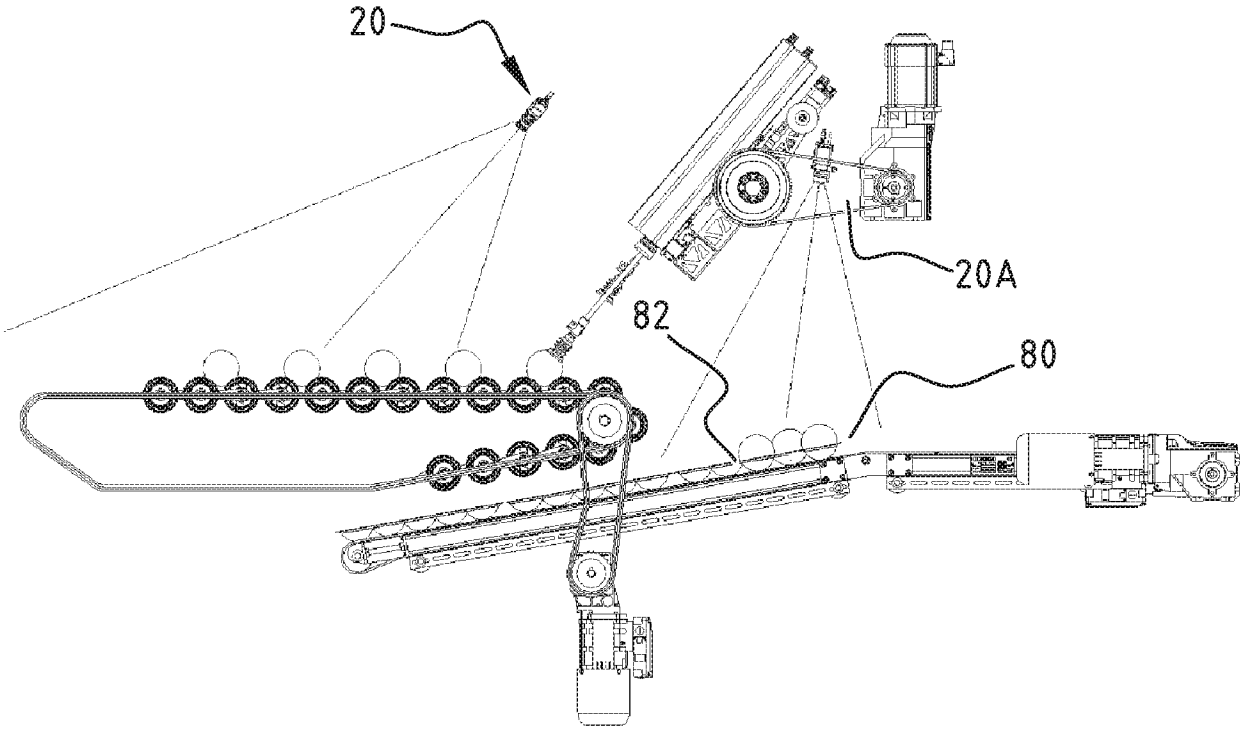
Figure 6B:
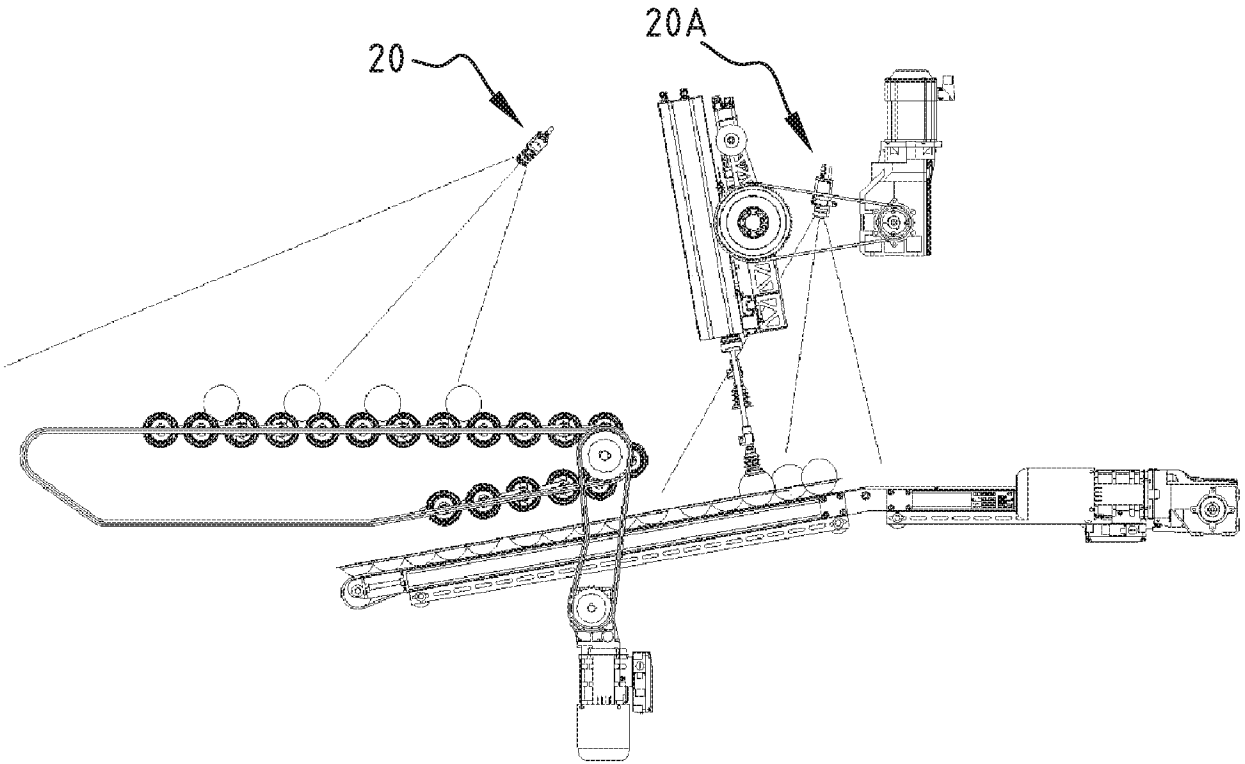
Figure 6C:
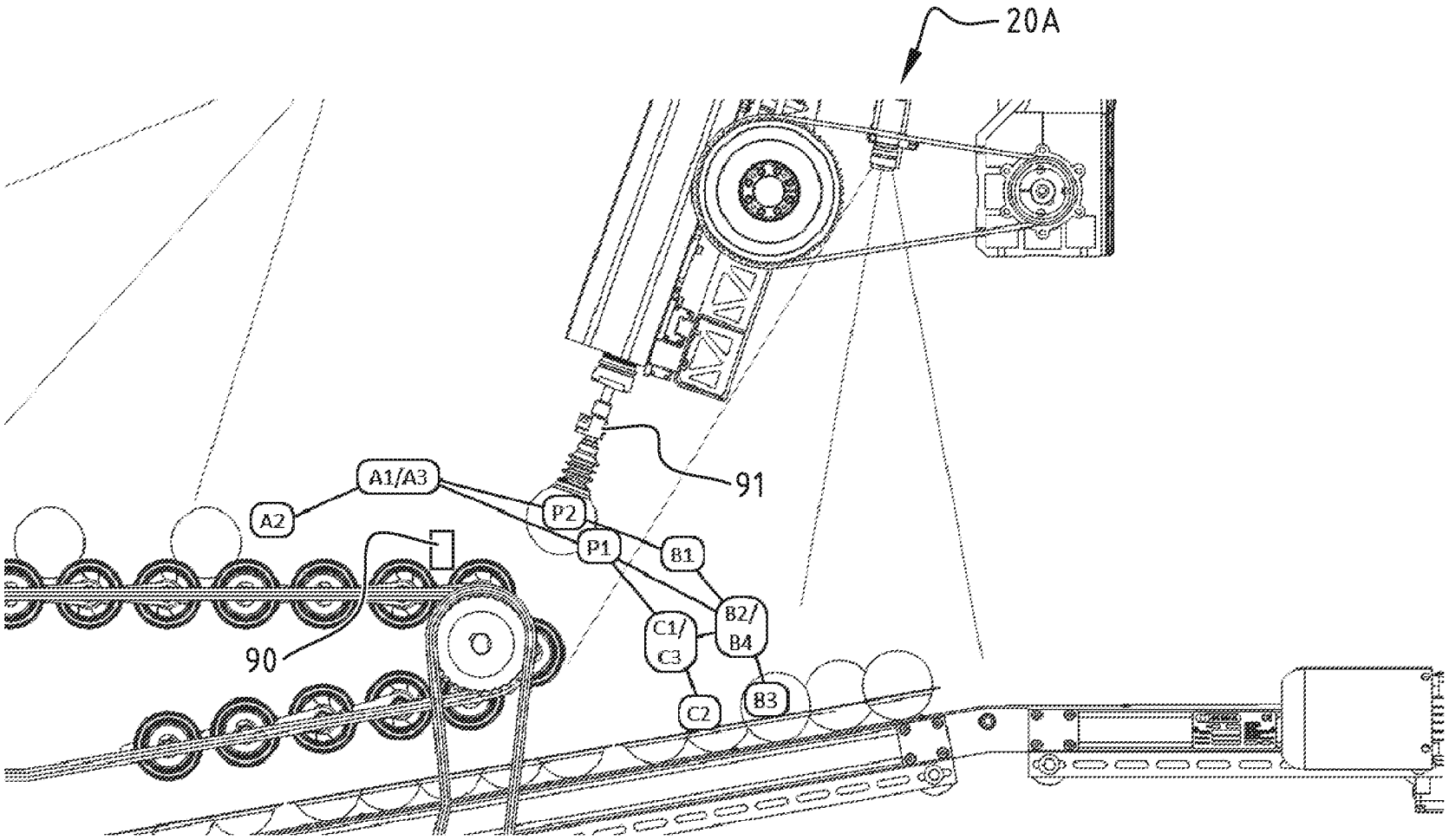
Figure 6D:
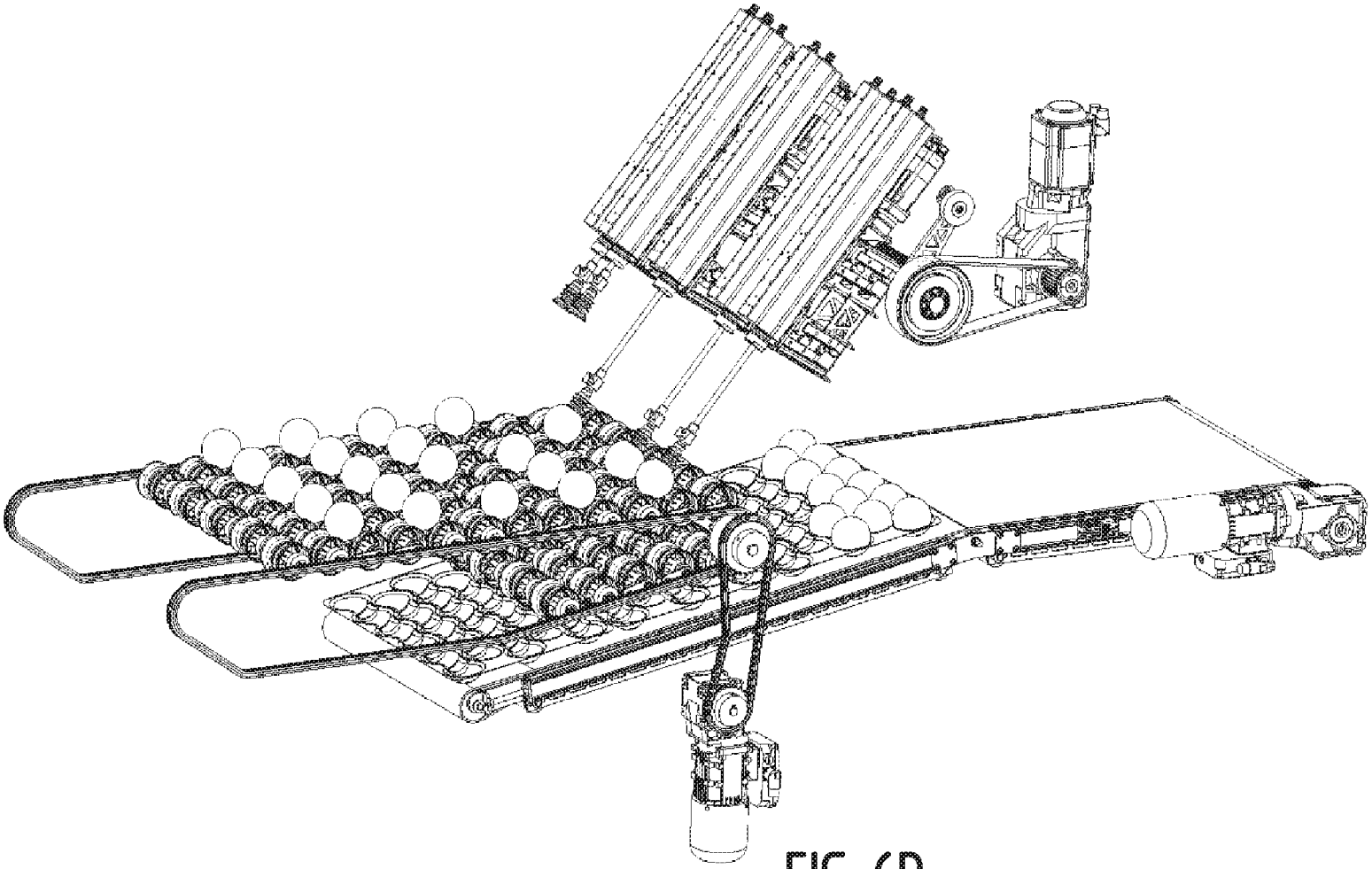
Figure 6E:
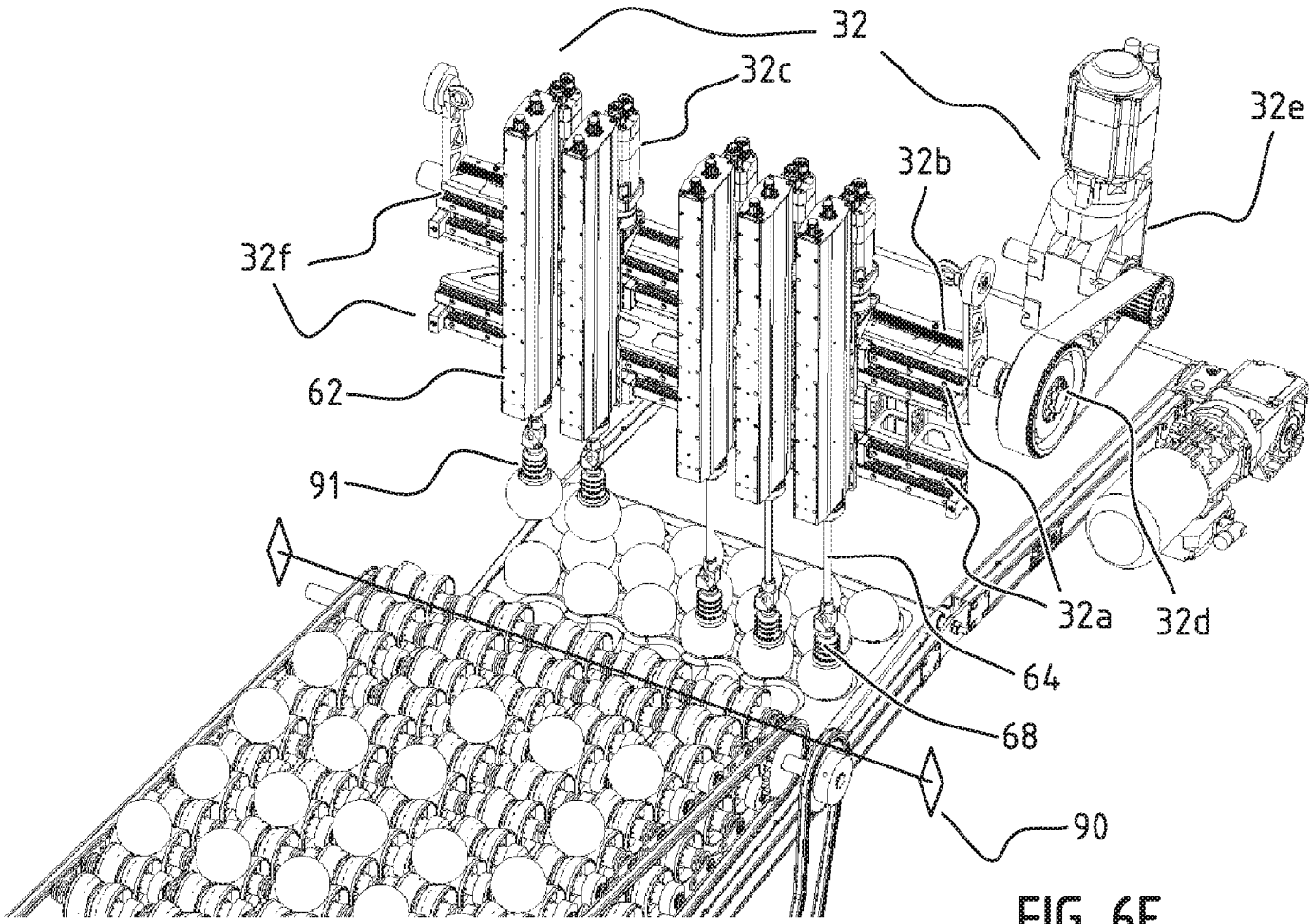
Figure 7A:
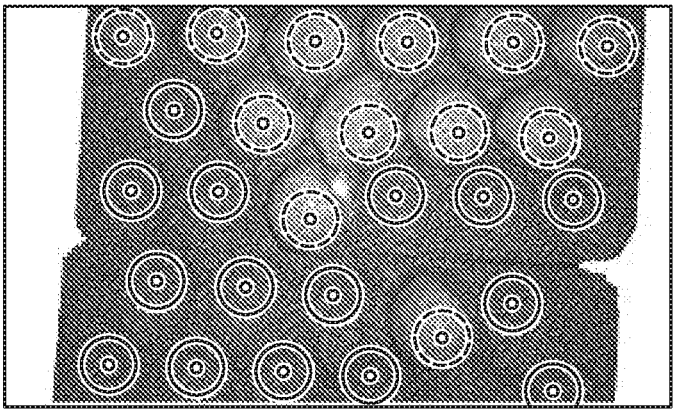
Figure 7B:
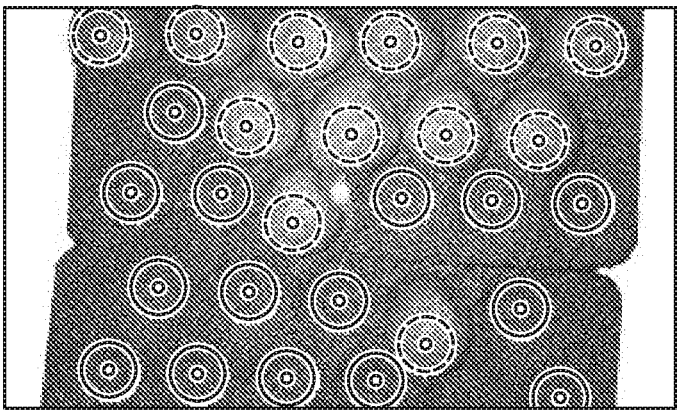
Figure 7C:
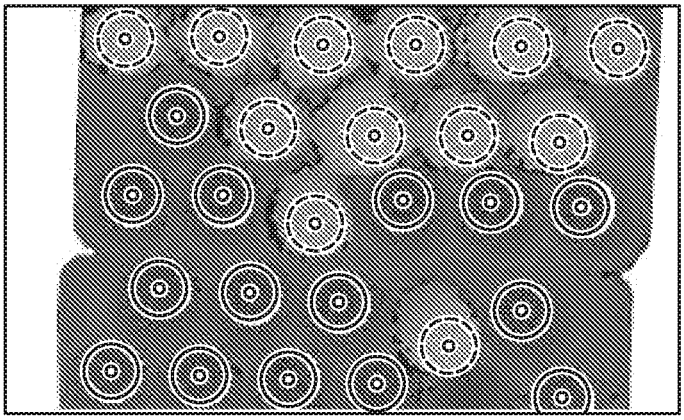

Further advantages, features and details of the invention are elucidated on the basis of preferred embodiments thereof, wherein reference is made to the accompanying drawings, in which:

FIGS. 1A-B show a side view of a packaging device according to the invention;

FIG. 2 shows a side view of the measuring and positioning path of the packaging of FIG. 1;

FIGS. 3A-C show a cross-section of the packaging device of FIG. 1 with a plurality of transport paths;

FIGS. 4A-C show views of the packaging robot;

FIG. 5 shows a top view of particularly the discharge of a packaging for the packaging device of FIG. 1;

FIGS. 6A-E show views of an embodiment of the packaging device according to the invention; and FIGS. 7A-C show representations of the 3D imaging process.

Packaging line 2 (FIGS. 1A-B) is supplied in use from feed system or sorting device 4 with which products P are supplied. In the shown embodiment products are here placed from sorting system 4 onto conveyor belt 6 and carried to elevator system 8, and are then transferred via dosing system 10 to measuring and positioning path 12. Part 14 is here provided at a slight incline in order to place products P onto the desired position on measuring and positioning path 12. Products P on measuring and positioning path 12 are rotated using directing system 16 and assessed using measuring system 18. In the shown embodiment measuring system 18 is provided with first camera system 20 whereby measuring signals 22 about product properties such as bloom, stalk and/or calyx are obtained. Obtained measuring signals 22 are transmitted to controller 24, with which image processing device 26 is integrated in the shown embodiment. Also provided is second camera system 28 which is directed at the set-down positions. Measurement information 30 of second camera system 28 is likewise supplied to controller 24 with the, in the shown embodiment, integrated image processing device 26. Packaging robot 32 is configured to transfer products P from measuring and positioning path 12 to packaging filling station 34. In the shown embodiment filling station 34 is provided with feed and discharge system 36 for discharge of full packagings 37. A tray/packing tray is here usually positioned in packing box 37 by a number of trays for further transport and storage.

Measuring and positioning path 12 is provided with a number of transport assemblies 38 (FIG. 2) which are each provided with a first roller element 40 and a second roller element 42, embodied as diabolos in the shown embodiment. Diabolos 40, 42 of transport assembly 38 define product position 44 on transport assembly 38. The totality of transport assemblies 38 defines path 12.

Directing system 16 makes it possible to rotate products P separately on each individual transport assembly 38. Because the positions between two adjacent transport assemblies 38 can be empty, each product P can be rotated individually on its own transport assembly 38. Directing system 16 enables movement of product P at product position 44 and is provided here with a first measuring directing part 46 which is used in the shown embodiment to rotate product P relative to camera system 20 and to determine the product properties. Directing system 16 is further provided with product orientation part 48 which can selectively rotate product P on transport assembly 38 during transport of product P in transport direction A.

In the shown embodiment product orientation directing part 48 is placeable in a first rolling position in which diabolos 40, 42 are driven and product P is rotated on transport assembly 38, and a second folded-away, inactive position in which the diabolos 40, 42 are not driven and the product remains in the same orientation on transport assembly 38 during transport in direction A on measuring and positioning path 12. Product orientation directing part 48 will be transferred from the active position to the folded-away inactive position as soon as product P has a suitable pick-up orientation. For this purpose product orientation part 48 is provided in the shown embodiment with fixed part 52 whereby movable part 50 with a parallelogram construction is displaceable between the rolling position and the inactive position.

In the shown embodiment measuring and positioning path 12 (FIGS. 3A-C) is provided with four product paths or tracks 54*a,b,c,d*. Each track 54*a-d* is provided with separate drive 56*a-d*, wherein each separate drive 56*a-d* is provided with a parallel drive 56*a*1, 56*a*2, 56*b*1, 56*b*2, 56*c*1, 56*c*2, 56*d*1 and 56*d*2, whereby it is possible to drive two transport assemblies 38, placed consecutively in transport direction A, individually on the same track 54*a-d* in that contact elements 58 of the individual drives 56*a*1, 56*a*2, etc engage on the specific contact elements 60 of the successive transport assemblies 38. In the shown embodiment contact elements 58 on the measuring part 46 of directing system 16 are in substantially continuous contact with the respective contact elements 60 of their corresponding transport assembly 38, while contact elements 58 of product orientation part 48 of directing system 16 can optionally be folded away from contact element 60 in order to thereby avoid product rotation of product P on transport assembly 38 during that stage of transport in direction A as soon as product P has reached the desired pick-up orientation.

In the shown embodiment packaging robot 32 is provided with four robot arms 62*a,b,c,d* (FIGS. 4A-B) or five arms 62*a,b,c,d,e* (FIG. 4C). It will be apparent that a different number of robot arms 62 is also possible. The number of robot arms 62 is optionally different to the number of paths 12, for instance four arms 62 for five paths 12.

Robot arm 62*a-d* (FIGS. 4A-B) and robot arm 62*a,b,c,d,e* (FIG. 4C) is provided with an extending mechanism 64 in the form of an extendable longitudinal shaft which can change the length of arm 62*a-e* in direction B, in the shown embodiment by a maximum distance Z (FIG. 4C). The outer end of arm 62*a-e* is provided with suction cup 68 whereby product P can be picked up. Robot arm 62*a-e* is further provided with longitudinal shaft rotation mechanism 66 to enable rotation of arm 62*a-e* about the longitudinal shaft in direction C for the purpose of adjusting the orientation of product P. Each robot arm 62*a-e* is further provided with transport rotation mechanism 70 for rotating robot arms 62*a-e* in direction D and optionally direction G. The combined movements B, C, D, G make it possible to transfer product P from a pick-up position of measuring and positioning path 12 to the packaging at the suitable set-down position with desired product orientation. Use is further made here of a displacement in transverse direction E, i.e. transversely of transport direction A of robot arm 62*a-d*, using packaging robot displacing mechanism 72 whereby movement in range 74*a*, 74*b* can be performed and wherein the individual robot arms 62*a-e* have been placed at a mutual distance 76, i.e. pitch. Discharge system 78 carries packagings such as trays or packing trays 80 further in transport direction F (FIG. 5). Trays 80 are provided with individual fruit holders or product compartments 82.

Middle robot arms 62*b-c* are preferably used for picking up (FIG. 4C). This is because the greatest possible portion of the packing tray can be reached by means of lateral displacement from these robot arms. This provides flexibility when a malfunction occurs during setting down, wherein the set-down positions must be recalculated. In the shown embodiment the middle robot arm(s) can reach all pick-up and set-down positions.

In the shown preferred embodiment the width of and the distance between the different robot arms 62*a* . . . 62*e* is smaller than the usual minimum product diameter, so that the products can be set down adjacently of each other in one movement. This is shown schematically in FIG. 4C. This width b is preferably smaller than 60 mm.

In order to further be able to fill each position on packing tray 80 from each feed path 54*a-d* it is necessary, at minimum, that the middle robot arm 62 can pick up products from all feed paths and can set them down in all pockets of packing tray 80. For this purpose the width of the packaging robot displacing mechanism mounted on the transport rotation mechanism must allow for the robot arms 62 to the left of the middle robot arm to be moved into a parked position on the left-hand side of the packing tray (see FIG. 4C) and the robot arms to the right of the middle robot arm to be moved into a parked position on the right-hand side of the packing tray (see FIG. 4C).

In the shown embodiment the width b of the packing tray is about 60 cm and the robot has five robot arms 62 with a width of 58 mm. The greatest distance Y, measured heart-to-heart, between the robot arms 62*a* and 62*e* is about 814 mm, making it possible to place two robot arms 62 outside the packing tray area so that the middle robot arm can reach the extreme pockets in packing tray 80 (see FIG. 4C).

A possible embodiment for a packaging device or packaging line 2 is further described hereinbelow. It will be apparent that variants and other combinations of components according to the invention are possible.

In a shown preferred embodiment according to the invention camera 20 (FIGS. 6A-B) is positioned above path 12, comprising a plurality of parallel measuring and positioning paths 54*a-d*, provided with directing system 16. Camera 20 here tracks the positions where products are located and preferably transmits the position, size and orientation of these products to controller 24. Controller 24 registers the positions of products P during transport until they are situated in the pick-up area of packaging robot 32 (FIG. 6A) and then controls packaging robot 32 to pick up products P and set them down in packaging 80 (FIG. 6B). Extending mechanism 64 enables a compact construction by realizing a change in length during the rotation movement (compare FIGS. 6A-B).

Camera 20A, 28 (FIGS. 6C-D) is positioned above and/or directed at the set-down portion, and can preferably oversee this set-down portion when robot arm 62*a-d* is rotated to the pick-up position (FIG. 6A). With camera 20A, 28 a recording of packaging/packing tray 80 is made and it is assessed which potential set-down positions are filled and which are available. In the shown preferred embodiment camera 20A is a 3D camera comprising an assembly of preferably two cameras, a random pattern projector and a vision module for processing both camera images into a 3D image (FIGS. 6A-C).

In the image obtained by means of camera 20A the grayscale represents the height. By means of this image the pockets are detected by searching a filtered 3D image for the local minima, the so-called pockets, which indicate the available set-down positions (empty/dark/red circles in FIGS. 7A-C) (filled pockets are indicated with filled/light/green circles in FIGS. 7A-C). The position and the size of these pockets are transmitted to controller 24. By providing a 3D image at suitable moments it is checked whether all planned pockets have actually been filled. If a fruit has rolled away, and a pocket has therefore remained empty, it will be filled with priority in the subsequent set-down movement. The position which was not supposed to be filled is skipped in the subsequent set-down movement. It is also possible to perform a check for product dimension and set-down position and, if desired, generate an alarm notification.

Controller 24 preferably checks the depth of the set-down position. This prevents product damage caused by an excessive drop height or due to robot arm 62*a-d* setting too far down.

It is additionally possible with controller 24 to check the alignment of packaging 80 with paths 54*a-d* and optionally perform a correction for the movement(s) of robot arm(s) 62 *a-d*.

On the basis of the size and position of the detected empty pockets on packing trays/packagings 80 and the size and positions of the products P present on the measuring and positioning path 12 controller 24 will determine which product P should end up in which empty pocket, which robot arm 62*a-d* is used for this purpose and which path/trajectory will be travelled by robot arm 62*a-d*. Products P will thus for instance first be allocated to a front row of pockets 82 on packing tray 80 which has not yet been filled. The pockets are preferably filled row by row. It is further also determined via which robot arm 62*a-d* a product P must be picked up in order to be able to reach the set-down position. It is generally the case that the pitch of feed 12, 54*a-d* and the pitch of the pockets do not correspond. It is further generally the case that not every path 54*a-d* has a product P available to be picked up and that not all mutually adjacent pockets on packing tray 80 are empty.

Controller 24 then controls the lateral displacement of robot arms 62*a-d* with packaging robot displacing mechanism such that arms 62 are aligned with products P for picking up during pick-up, if necessary move laterally during transport by means of the rotation movement, and are aligned with the set-down positions during set-down. This is for instance visible in FIG. 6D. If more products P have been picked up than there are empty pockets available in the first row, the first row is filled and the remaining products P are placed in the subsequent row (see FIG. 6E). Herein, packing tray 80 is optionally transported forward as well as rotation transport mechanism 70 turning backward slightly. This first row lies at the position of B3 in FIG. 6. The subsequent row lies at the position of C2 in FIG. 6. In the shown embodiment controller 24 here, in succession, first brings the angle of the transport rotation mechanism in line with B3, wherein products P for this row are positioned in the pocket by means of the longitudinal shaft of robot arm 62*a-d* and the vacuum is released from the suction cup and the longitudinal shaft is retracted to position B4 again. Controller 24 then rotates the angle of the transport rotation mechanism in line with set-down row C2 and products P are set down in the subsequent row by extending the longitudinal shafts associated with products P from C3 to C2, releasing the vacuum and retracting the longitudinal shafts.

Optional photocell 90 (FIGS. 6C,E) checks whether anything has remained behind on path 54*a-d*. If this is the case, controller 24 can move robot arm 62*a-d* to angle P2 (FIG. 6C) so that it no longer blocks the view of camera 20A, after which a new 3D image is made by means of camera 20A.

In a current preferred embodiment the product pick-up element comprises a suction cup. In order to check that no products P have been released unintentionally, for instance due to differing shape or a poorly functioning suction cup, each robot arm 62*a-d* is optionally provided with flow meter 91 (FIGS. 6C,E). Just before set-down, it is checked by means of flow meter 91 that product P is still hanging on the suction cup. If this is not the case, a 3D image can be made. For this purpose the robot will preferably first move back to a position outside the field of vision of the 3D camera, such as position P2 (FIG. 6C).

In a currently preferred embodiment transport rotation mechanism 32 (FIGS. 4C, 6E) comprises shaft 32*d* which is driven by servomotor 32*e* and has packaging robot displacing mechanism 32*f* mounted thereon for the purpose of laterally displacing robot arms 62. For this purpose arms 62 are mounted on straight guides 32*a* and the lateral drive is provided for by servo-controlled travel motor 32*c*, provided with a pinion running over gear rack 32*b*. Travel motors 32*c* are provided here with a position encoder. Controller 24 here controls servo-controlled travel motors 32*c* of robot arms 62*a*-62*e* such that they are aligned for a pick-up movement with the products for picking up at the end of the transport paths, after which extendable and preferably rotatable longitudinal shafts 64 are controlled to pick up and set down the products by means of vacuum suction cup 68.

The transport path is shown in more detail in FIG. 6C. In rest position A1 controller 24 receives information about the positions of products P for picking up and the positions of the empty pockets in packing tray 80. On the basis thereof, controller 24 determines which robot arm 62 will be used, and controls the robot arms 62 by means of travel motor 32*c* such that the robot arms 62 are aligned with the pick-up positions. At the same time, rotation shaft 32*d* is controlled so that it comes to lie in line with pick-up position A2. The products that are present are then picked up with suction cups 68 by means of vacuum, after which the rotation transport mechanism lifts the products and retracts to position A3, and from there starts a set-down trajectory via P2, B1, B2 to B3 for the purpose of setting down products in free pockets on the packing tray. During the rotation trajectory the robot arms with the products to preferably be set down in the first row are (once again) laterally aligned by means of motor 32*c* with the empty pocket positions in the row at the position of B3. If more products P have been picked up than can be set down in the first row, the remaining products are then set down in a second row along a shorter path/trajectory via B3, B4, C1, C2. During this trajectory the robot arms with the products to be set down in the second row are preferably laterally aligned via motor 32*c* with the set-down positions in the second row. It is also possible that not all products can be set down in a double movement. This occurs when the packing tray lies greatly out of line relative to paths 54*a-d*, or at the end of packing tray 80. In this case robot 32 will return to position P2 with the still remaining products after the second row has been set down at position C2, and take a new 3D image by means of camera 20A. With the available positions found then the remaining products will be set down. In the event that no available positions are found at point P2, the belt for packaging 80 will advance.

As soon as all products have been set down, robot 32 is returned to position A1 via a shorter path/trajectory via P1 for the purpose of picking up and setting down a subsequent product in a subsequent movement.

Between picking up at position A2 and setting down at positions B3 and C2, the final adjustment in the orientation of product P is optionally made by rotating it by means of controlling the longitudinal shaft rotation mechanism 64.

It will be apparent that other embodiments for diverse components are possible according to the invention. Lateral displacement can thus for instance be performed with for instance a spindle at position 32*b* and a driven spindle nut at position 32*c* and/or travel motor 32*c* can be provided with an omega drive and 32*b* can take the form of a rigid belt or any drive for horizontal displacement and/or straight guides 32*a* can be replaced by any other bearing-mounted guide.

Products P are supplied with sorting system 4 and transferred via feed belt 6, elevator system 8 and dosing system 10 to inclining part 14 of measuring and positioning path 12. Using directing part 46 of directing system 16 products P are rotated on transport assemblies 38, wherein first camera system 20 determines product properties such as bloom, stalk, calyx. Measurement data 22 are transmitted to controller 24 with image processing system 26 so that a suitable pick-up position can be determined, taking into consideration the desired product orientation. Using product orientation directing part 48, product P is then moved into the desired pick-up orientation. After being moved into this orientation, product orientation part 48 is moved from an active state to a folded-away inactive state so that the product position on product assembly 38 is maintained until packaging robot 32 is able to take up product P. In the shown embodiment product P is here picked up using suction cup 68. Using rotation mechanism 70, a rotating movement is made from the pick-up position on the measuring and positioning path 12 to packaging 80, particularly product compartment or fruit holder 82 thereof. The desired position is here reached with extending mechanism 64, optionally in combination with packaging robot displacing mechanism 72. Using rotation mechanism 66, the desired product orientation of for instance the stalk-calyx axis is realized. After products P have been placed in packaging 80, packaging 80 is transported further using discharge system 78.

When setting down products P in packaging 80, use is optionally made of second camera system 28 directed at packaging 80. Second camera system 28 is used to determine the suitable set-down positions wherein measuring signals 30 are transmitted to controller 24, preferably with integrated image processing system 26. Controller 24 is preferably used to control camera system 20, camera system 28, directing system 16 and packaging robot 32 using control signals 31 (shown schematically). It is possible, if desired, to integrate controller 24 with a whole controller for the overall production line, for instance together with the controller of sorting system 4.

The present invention is by no means limited to the above described preferred embodiments thereof. The rights sought are defined by the following claims, within the scope of which many modifications can be envisaged. It is thus for instance possible to apply a different number of tracks or paths, for instance one, two or another suitable number. Although the number of robot arms 62 is preferably adapted to the number of tracks or paths 54, it is also possible to serve for instance a plurality of tracks with a single robot arm. Provided in the shown embodiment is discharge system 78, which is partially carried along underneath measuring and positioning path 12 in order to realize a compact construction. It will be apparent that a different configuration hereof is also possible, for instance also depending on the operational setup as a whole.

The invention claimed is:

1. A packaging device for directional packaging of products, comprising:

a feed system configured to feed products and a packaging transport system for supplying and discharging packagings;

at least one measuring and positioning path connected operatively to the feed system for transporting products in a transport direction;

a measuring system connected operatively to the at least one measuring and positioning path and configured to measure properties of the product;

a directing system for directing the product on the at least one measuring and positioning path in a suitable pick-up orientation for the product;

a packaging robot comprising a product pick-up element for picking the product up from the at least one measuring and positioning path in the suitable pick-up orientation and configured to set down the product in a packaging with a desired product orientation; and wherein the packaging robot is provided with a robot arm, comprising:

a transport rotation mechanism for transferring the product from the at least one measuring and positioning path to the packaging with a main rotation movement, and the transport rotation mechanism comprises a longitudinal shaft extendable in longitudinal direction; and a robot arm displacing mechanism configured to displace the robot arm substantially in a transverse direction to the transport direction; and the packaging device comprising a controller for controlling the measuring system, the directing system and the packaging robot, wherein the controller is further provided with a set-down detection system configured to detect set-down positions that are possible at that moment, wherein the set down detection system is further provided with a correcting mechanism which is configured to check whether the product has been set down correctly and wherein the set-down detection system is further configured to detect a set-down pattern in the packaging.

2. The packaging device according to claim 1, wherein two or more measuring and positioning paths placed substantially parallel are provided.

3. The packaging device according to claim 2, wherein each of the measuring and positioning paths is provided with a separate robot arm, wherein the individual robot arms are preferably provided around a joint transport rotation shaft.

4. The packaging device according to claim 1, wherein the robot arm is further provided with a longitudinal shaft rotation mechanism.

5. The packaging device according to claim 1, wherein the robot arm displacing mechanism is configured to displace the robot arm in transverse direction to the transport direction during a main rotation movement.

6. The packaging device according to claim 1, wherein the controller is configured to process information obtained with the measuring system about the product and to determine a suitable pick-up orientation for the product, wherein the controller is further configured to determine a suitable set-down position for the product in the packaging and wherein the controller further comprises an optimizer configured to determine an order of products for picking up and/or a suitable set-down position for picked-up products.

7. The packaging device according to claim 1, further comprising a packaging positioning system configured to position the packaging in co-action with the controller.

8. The packaging device according to claim 1, wherein the measuring system comprises a camera system and wherein the measuring system is configured to detect at least one suitable pick-up orientation of the product for packaging.

9. The packaging device according to claim 1, wherein the directing system comprises a measuring directing part configured to rotate the product during transport of the product in the transport direction for the purpose of the measuring system, and a product orientation part configured to orient the product for packaging during transport of the product in the transport direction, wherein the directing system is configured to direct a product such that at least one suitable pick-up orientation lies in an operating range of the packaging robot.

10. The packaging device according to claim 9, wherein the directing system comprises an activating element whereby the product orientation part of the directing system is activatable in use until the product on the transport assembly has a suitable pick-up orientation, and/or wherein the directing system is provided with at least two drives operating in parallel, wherein at least two adjacent product assemblies for at least the product orientation part are independently drivable.

11. The packaging device according to claim 1, wherein the at least one measuring and positioning path comprises one or more transport assemblies for transport of products in a transport direction, wherein each transport assembly comprises two roller elements, lying adjacently in the transport direction, which define a product position.

12. The packaging device according to claim 1, further comprising a dosing system placed between the feed system and the at least one measuring and positioning path.

13. The packaging device according to claim 1, further comprising an elevator conveyor placed between the feed system and the at least one measuring and positioning path.

14. A packaging device for directional packaging of products, comprising:

a feed system configured to feed products and a packaging transport system for supplying and discharging packagings;

at least one measuring and positioning path connected operatively to the feed system for transporting products in a transport direction;

a measuring system connected operatively to the at least one measuring and positioning path and configured to measure properties of the product;

a directing system for directing the product on the at least one measuring and positioning path in a suitable pick-up orientation for the product, wherein the directing system comprises a measuring directing part configured to rotate the product during transport of the product in the transport direction for the purpose of the measuring system, and a product orientation part configured to orient the product for packaging during transport of the product in the transport direction, wherein the directing system is configured to direct a product such that at least one suitable pick-up orientation lies in an operating range of the packaging robot;

a packaging robot comprising a product pick-up element for picking the product up from the at least one measuring and positioning path in the suitable pick-up orientation and configured to set down the product in a packaging with a desired product orientation; and wherein the packaging robot is provided with a robot arm, comprising:

a transport rotation mechanism for transferring the product from the at least one measuring and positioning path to the packaging with a main rotation movement, and the transport rotation mechanism comprises a longitudinal shaft extendable in longitudinal direction; and a robot arm displacing mechanism configured to displace the robot arm substantially in a transverse direction to the transport direction; and the packaging device comprising a controller for controlling the measuring system, the directing system and the packaging robot.

15. A packaging device for directional packaging of products, comprising:

a feed system configured to feed products and a packaging transport system for supplying and discharging packagings;

at least one measuring and positioning path connected operatively to the feed system for transporting products in a transport direction;

an dosing system placed between the feed system and the at least one measuring and positioning path;

a measuring system connected operatively to the at least one measuring and positioning path and configured to measure properties of the product;

a directing system for directing the product on the at least one measuring and positioning path in a suitable pick-up orientation for the product;

a packaging robot comprising a product pick-up element for picking the product up from the at least one measuring and positioning path in the suitable pick-up orientation and configured to set down the product in a packaging with a desired product orientation; and wherein the packaging robot is provided with a robot arm, comprising:

a transport rotation mechanism for transferring the product from the at least one measuring and positioning path to the packaging with a main rotation movement, and the transport rotation mechanism comprises a longitudinal shaft extendable in longitudinal direction; and a robot arm displacing mechanism configured to displace the robot arm substantially in a transverse direction to the transport direction; and the packaging device comprising a controller for controlling the measuring system, the directing system and the packaging robot.

16. A packaging device for directional packaging of products, comprising:

a feed system configured to feed products and a packaging transport system for supplying and discharging packagings;

at least one measuring and positioning path connected operatively to the feed system for transporting products in a transport direction;

an elevator conveyor placed between the feed system and the at least one measuring and positioning path;

a measuring system connected operatively to the at least one measuring and positioning path and configured to measure properties of the product;

a directing system for directing the product on the at least one measuring and positioning path in a suitable pick-up orientation for the product;

a packaging robot comprising a product pick-up element for picking the product up from the at least one measuring and positioning path in the suitable pick-up orientation and configured to set down the product in a packaging with a desired product orientation; and wherein the packaging robot is provided with a robot arm, comprising:

a transport rotation mechanism for transferring the product from the at least one measuring and positioning path to the packaging with a main rotation movement, and the transport rotation mechanism comprises a longitudinal shaft extendable in longitudinal direction; and a robot arm displacing mechanism configured to displace the robot arm substantially in a transverse direction to the transport direction; and the packaging device comprising a controller for controlling the measuring system, the directing system and the packaging robot.

* * * * *